US006009682A

United States Patent [19]

Lehman et al.

[11] Patent Number: 6,009,682

[45] Date of Patent: Jan. 4, 2000

[54] COMPOSITE HAND RAIL

[75] Inventors: Joseph A. Lehman, Audubon; Todd E. Rissmiller, Lancaster, both of Pa.

[73] Assignee: Audubon Products, Inc., Audubon, Pa.

[21] Appl. No.: 09/109,659

[22] Filed: Jul. 2, 1998

[51] Int. Cl.[7] ..... E04C 3/30

[52] U.S. Cl. ..... 52/720.2; 52/33; 52/309.1; 52/309.6; 52/730.1; 52/738.1; 256/1

[58] Field of Search ..... 256/1; 52/33, 309.4, 52/309.6, 309.1, 730.1, 738.1, 720.2

[56] References Cited

U.S. PATENT DOCUMENTS

| | | | |
|---|---|---|---|
| D. 344,141 | 2/1994 | Wonderly . | |
| D. 379,244 | 5/1997 | Wiebe . | |
| 3,562,403 | 2/1971 | Monahan | 256/1 X |
| 3,574,379 | 4/1971 | Jordan | 256/1 X |
| 3,992,838 | 11/1976 | Vizziello | 52/309.4 X |
| 4,142,814 | 3/1979 | Sanchez | 256/1 X |
| 4,216,634 | 8/1980 | Binder . | |
| 4,566,231 | 1/1986 | Konsevich . | |
| 4,617,217 | 10/1986 | Michaud-Soret . | |
| 4,795,666 | 1/1989 | Okada et al. . | |
| 5,209,036 | 5/1993 | Cancilliari | 52/309.4 |
| 5,396,739 | 3/1995 | Venegas, Jr. | 52/33 |
| 5,396,740 | 3/1995 | Bocchi | 52/33 |
| 5,448,869 | 9/1995 | Unruh et al. . | |
| 5,508,103 | 4/1996 | Cope | 428/318.8 |
| 5,678,381 | 10/1997 | DenAdel . | |

FOREIGN PATENT DOCUMENTS

| | | | |
|---|---|---|---|
| 740461 | 1/1933 | France | 52/738.1 |

*Primary Examiner*—Bell Aubrey
*Assistant Examiner*—Brian E. Glessner
*Attorney, Agent, or Firm*—Dan Williams

[57] ABSTRACT

A composite hand rail for supporting and protecting pedestrians on steps and inclined surfaces. The rail is a composite comprising a shell having a wide slightly convex top surface extending downwardly and laterally to a convex sidewall before returning and flaring down to a smaller waist section. The shell has an interior cavity open to the bottom that can receive a core material. Preferably the shell is of cellular blended polyvinylchloride or styrene with a hardened skin formed by celuka processing. A simulated wood finish is applied to the shell by hot stamping or paint and print processes. Shells can be easily formed into spiral and curvilinear shapes by bending around a form or mandrel. The decorative wood finish bends with the shell thus enhancing the decorative wood finish appearance. A core is prefabricated to fit within the shell cavity. The core is fastened within the cavity by either adhesive or mechanical means. Once the core is in place, an elongated bottom cap having a positioning flange is assembled and fastened with adhesive or mechanical means over the cavity and core. The cap may be of the same material as the shell to enhance to wooden appearance of the assembly.

9 Claims, 1 Drawing Sheet

Fig. 1
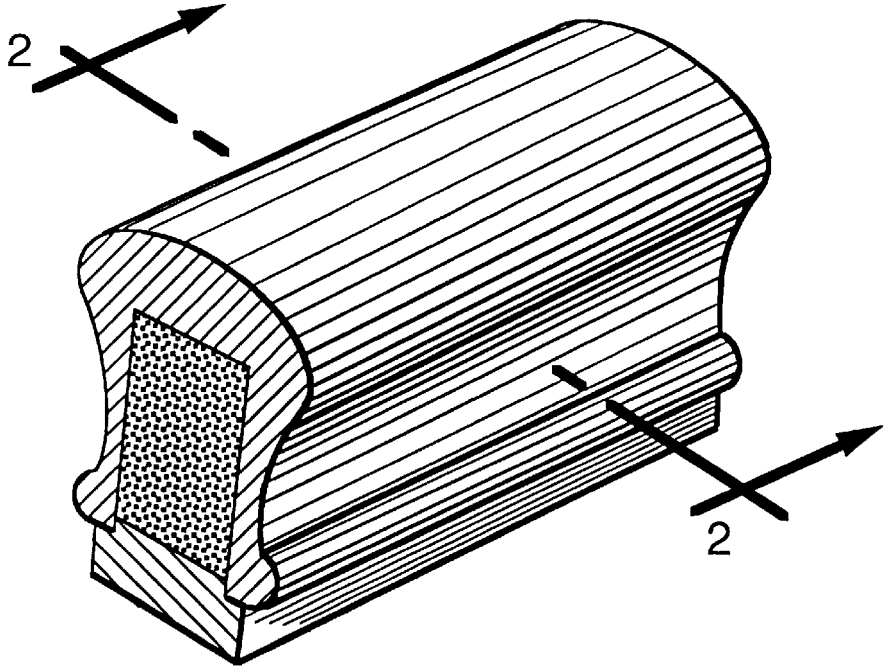
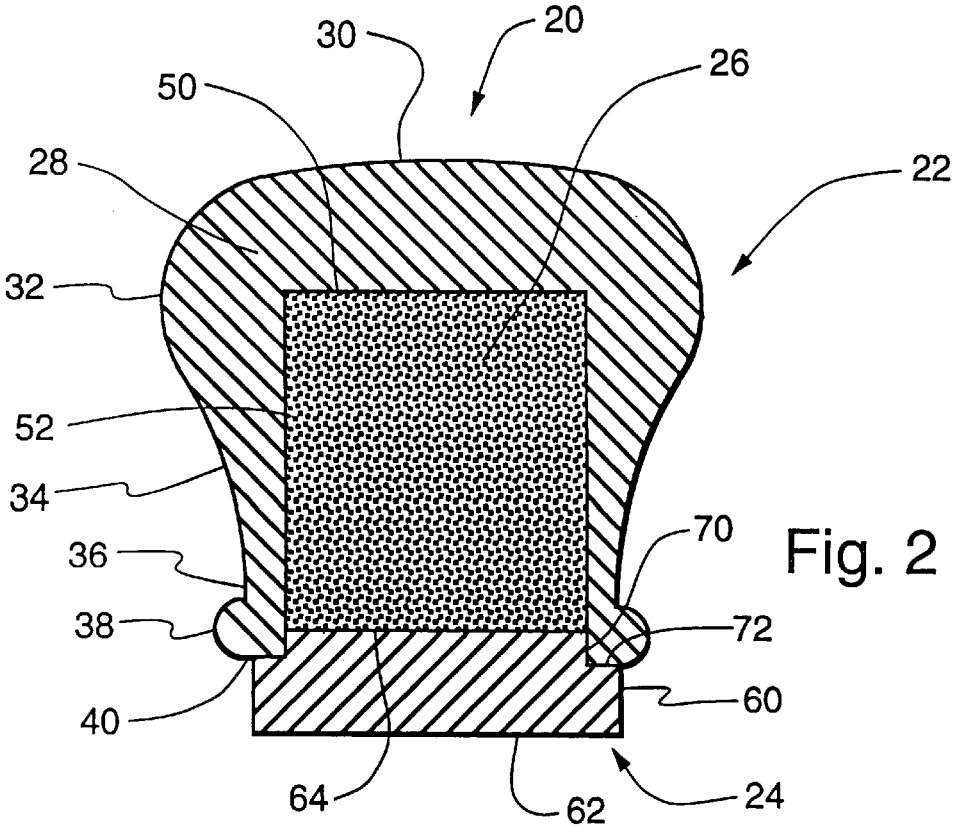
Fig. 2

COMPOSITE HAND RAIL

BACKGROUND

1. Field of the Invention

The present invention relates to hand rails used to support and balance pedestrians walking on stairs, ramps, or other uneven or slippery surfaces on which they may inadvertently lose their balance. More particularly, the present invention relates to a composite hand rail having a pleasing appearance, strong enough to achieve the traditional support functions of a hand rail, yet capable of being readily fabricated into designer specified curvilinear shapes.

2. Description of the Related Art

Hand rails are used to aid pedestrian balance when walking. Hand rails are commonly found on stairs and ramps having residential, commercial, and industrial applications. Building codes may require hand rails for stair and ramp applications.

Stairs and ramps often comprise of multiple flights thus requiring hand rails that are rectilinear or curvilinear. In these applications, the hand rail follows the perimeter of the stair or ramp. The hand rail must then negotiate corners that are commonly ninety degrees but may be nearly any imaginable angle.

Conventional hand rails are fabricated of straight lengths joined by curved or angled members that negotiate changes in height or direction. Goosenecks may join rising sections to horizontal sections and curved joinder pieces may link two straight sections as the rail passes around a corner. Decorative spiral shapes such as bullnoses or volutes provide ornamental beauty to hand rails. Depending on the complexity of the stair case, hand rails may also have gently curving or even spiral shapes. Curving or spiral shapes are complex, difficult and costly to manufacture. Problems are exacerbated if the shapes or curves are of varied increasing or decreasing radius and not constant radius sections.

Hand rails are typically fabricated of wood or metal sections. Metal sections are more common in industrial or commercial applications where strength and reliability is important. Wood is more common in residential applications where appearance becomes relatively more important.

Metal sections are best and most easily fabricated in straight lengths. Curvilinear sections such as volutes can be fabricated, however, such fabrication is costly. Joiner pieces such as over easings and quarter turns may be welded, wrought or cast. Balusters, and newel posts may be easily fabricated of the same metal. Metal hand rail sections are heavy and require adequate support from balusters, newel posts, or wall mounted hangers. When supported only by wall mounted hangers, the weight of metal railings requires consideration of wall fasteners and the distance between the hangers.

Wood systems are in wide use as structural and ornamental railings for residential and commercial applications. Wood is less rigid than metal and must be supported by balusters or wall hangers at more frequent intervals than metal railings. Straight wood sections are easily milled but, forming complex wooden curvilinear shapes such as bullnoses, volutes, and goosenecks is difficult and costly.

What is needed is a visually pleasing system that simulates the appearance of wood yet has strength and rigidity in long sections and that can be readily fabricated into simple or complex curvilinear or rectilinear shapes.

Wiebe, U.S. Pat. No. DES 379,244, shows a hand rail of indeterminate length having a uniform cross section. The top surface is wider than the central portion and the structure flares out at the bottom of the rail.

Wonderly, U.S. Pat. No. DES 344,141, teaches a composite rail having vertical laminations that contribute to a wood grain effect of the rail when viewed from the side. The bottom view shows an edge grain while the top of the rail capped with another thin section. The overall ornamental appearance of the rail is that of multiple wood grains in a typically shaped hand rail.

Binder, U.S. Pat. No. 4,216,634, discloses a composite building column in which a plurality of thin walled hollow shells are filled with a core material such as plastic foaming material. The shell is formed from a sheet of lightweight material such as aluminum.

DenAdel, U.S. Pat. No. 5,678,381, teaches an insulated composite beam that is formed by enclosing an elongated plastic member with structural channels.

Although the prior art apparatus solved their specific ornamental and structural goals, the inventors did not address the problems encountered by attempting to provide a simulated wooden appearance, curvilinear shaping ability, and sufficient structural rigidity at a reasonable cost.

SUMMARY OF THE INVENTION

One object of the present invention is to provide a method of manufacturing an inexpensive yet easily decorable hand rail.

Another object of the present invention is provide a hand rail which is stiff and rigid requiring a minimum of supporting members.

Yet another object of the invention is to provide a method by which spiral and other complex shaped hand rails can be readily fabricated at a minimum cost.

Still another object of the invention is to provide a hand rail that is easily decorable and is readily fabricated to simulate wood.

Another object of the invention is to provide a hand rail which can be readily fabricated into curvilinear sections and treated to give a simulated wooden appearance, while possessing sufficient rigidity to require a minimum of support.

These and other objects are realized by providing a composite rail with a decorative cap. The rail has an external shell formed of elongated plastic. The shell's top exterior portion is similar in shape to conventional hand rails now in common use. The extruded shell also partially surrounds a central cavity open to the bottom of the shell. It is most desirable to size the cavity to be between forty to ninety percent of the height of the hand rail shell and about fifty to ninety percent of the width of the hand rail shell at the waist of the rail. If the cavity is rectangular in shape, fabrication of a structural member to fit the cavity is facilitated. Fabricating the shell extrusion of material such as cellular blended polyvinylchloride further allows celuka processing which provides a hard skin on the extruded shell's surface. The exterior of the elongated extruded shell is finished to simulate the appearance of wood. Finishing is by hot stamping or by a paint and print process, both processes of which are well known in the industry. Decorative finishing is accomplished while the elongated extrusion is straight. The extrusion may then be bent to curvilinear shapes such as bullnoses, volutes, or gently curving shapes. After bending, the wood grain appearance generated by hot stamping or paint and print follows the curvature of the bend, thus producing a piece that closely simulates the appearance of wood grain.

A core is fabricated to fit within the cavity in the extrusion but the core is slightly less in height than the height of the cavity. The height difference allows the core to fit completely within the cavity and provides a notch on the bottom surface of the rail. The notch facilitates positioning and securing a decorative cap on the bottom surface of the shell. If desirable, the core and cap can be bent to the same shape as the elongated shell before the core and cap are assembled on the shell.

Structural integrity of the core and cap is assured by applying adhesive to the shell cavity, exterior surface of the core, and the mating surface of the cap. After adhesive application, the core, cap and shell are assembled and the adhesive allowed to cure.

BRIEF DESCRIPTION OF THE DRAWINGS

These and other features, aspects, and advantages of the present invention will become better understood with regard to the following description, appended claims, and accompanying drawings where:

FIG. 1 is a perspective view of a section of our indeterminate length hand rail;

FIG. 2 is a cross section view of our hand rail.

DETAILED DESCRIPTION

Although the disclosure herein is detailed and exact to enable those skilled in the art to practice the invention, the physical embodiments herein disclosed merely exemplify the invention which may be embodied in other specific structures. The scope of the invention is defined in the claims appended hereto.

FIG. 1 illustrates a perspective view of a section of our indeterminate length hand rail. FIG. 2, a cross sectional view through section 2—2 of FIG. 1, better shows the individual components and structure of our invention.

Referring to FIG. 2, handrail 20 is generally comprised of shell 22, cap 24 and core 26. Shell 22 has a flattened slightly convex exterior top surface extending laterally into convex flare 32. The outermost portion of convex flare 32 is the widest extremity of the handrail. The exterior surface of shell 22 extends around convex flare 32 to concave return 34 and thence to waist 36. Positioned at the bottom of waist 36 is decorative bead 38, the bottom of which is the bottom of shell 22. It is preferred that decorative bead 38 be integrally formed as part of an extrusion of shell 22, however, bead 38 can also be formed as a separate piece and then applied to shell 22 with adhesive means or mechanical fasteners.

The interior of shell 22 has an upper interior surface 50 and a pair of interior sidewalls 52 that define three sides of an interior volume.

Shell 22 can be fabricated of any extrudable material, however, from a cost viewpoint it is desirably fabricated of plastic. Since hand rail 20 is designed to emulate a wooden railing and to be easily cut, drilled, and otherwise worked, the preferred material is an extruded cellular blended polyvinylchloride with a celuka skin. A celuka skin is a hard surfacing process applicable to polyvinylchlorides and styrenes. The benefit of extruded cellular blended polyvinylchloride with a celuka skin is that it is inexpensive, easily decorable, paintable, hot stampable, stainable and can be easily cut and routed with conventional tools. Another important benefit is that it can be drilled and it holds screw type fasteners.

Shell 22 can be fabricated of other types of plastics such as polystyrene, styrene, polyvinylchloride and derivatives thereof. A pultrusion process may be added to increase the strength and impact resistance of the extrusion.

As extruded, shell 22 is an elongated straight section. Another desirable feature of the aforementioned plastic extrusion is that shell 22 may be readily bent to form a curvilinear elongated form such as the spirals, bullnoses and volutes commonly found in hand rails. The procedure for bending shell 22 is to heat the shell to a temperature range of 150–300 degree Fahrenheit for three to five minutes depending on the cross sectional area of the shell. The time and temperature is not critical. The only criteria is that shell 22 must be warm enough to readily bend but not so warm that it be uncontrollably limp. Once warm, shell 22 is readily bent around a prefabricated form or mandrel to achieve the desired curvature.

Cap 24 is a flanged rectangular section comprised of two parallel surfaces, cap bottom 62 and cap interior surface 64. Bottom 62 and interior surface 64 are on essentially parallel planes. Bottom 62 is wider than interior surface 64 forming cap seat 72. Seat edges 70 are defined by the width of interior surface 64, and are as designed to fit in the space between interior sidewalls 52 of shell 22.

The thickness of cap 24 is defined by the distance between cap bottom 62 and cap interior surface 64. Part of this distance is determined by the thickness of cap sidewall 60; the remainder is defined by the thickness of seat edges 70. As best seen in FIG. 2, seat edges 70 abut interior sidewalls 52.

Cap 24 can be fabricated of any extrudable material such as plastic or metal or of any material that can be easily shaped. If desired, cap 24 may be bent in the same manner as shell 22. Cap 24 can also be made of milled wood. However, it is contemplated that cap 24 will be made of the same material as shell 22. This is generally expected to be an extruded cellular blended polyvinylchloride formed with a celuka process although other types of extrudable plastic could be suitable.

When cap 24 is placed on shell 22 and cap 24 as shown in FIG. 2, cavity 28 is defined by cap interior surface 64, shell upper interior surface 50 and shell interior sidewalls 52. Since extruded plastics have less rigidity than metals or wood, it is desirable to fill cavity 28 with a more rigid material so the resulting composite structure has better rigidity and the distance between hand rail supports can be increased.

Insertion of core materials can be accomplished by several methods. In the preferred embodiment, the core material is shaped before insertion into cavity 28. Depending on the core material, the core is rolled, extruded, planed, shaped, or milled into the desired shape. Furthermore, core 26 can be bent to the same curvilinear shape as shell 22 and cap 24 before insertion in cavity 28. The exterior surfaces of core 26, interior surface 50 and interior sidewalls 52 are desirably coated with adhesive before core 26 is inserted into cavity 28. Alternatively, either the exterior surfaces of core 26 or the interior surfaces that define cavity 28 can be coated with adhesive. Suitable adhesives include but are not limited to hot melts, epoxies, glues and other derivatives of these materials. If extruded cellular blended polyvinylchloride, metals, or materials that hold conventional fasteners such as nails or screws, are used as the shell material, core 26 can be fastened in cavity 28 by mechanical fastening means such as screws.

Numerous core materials may be suitable for use depending on the mechanical properties, cost and availability of each specific material. Such materials medium density fiberboard, wood, rigid PVC, open cell PVC foam, metals such as aluminum and steel, gypsum, gunite and even concrete with reinforcing bar may be suitable for specific applications. It is also possible to foam cavity 28 in place either after or before cap 24 has been placed in position on shell 22.

Once core 26 has been fabricated, inserted and fastened into cavity 28, cap 24 is positioned so that cap seat 72 rests on bottom 40 and fastened in place. Depending on the materials used for shell 22, cap 24 and core 26, the cap may be secured by adhesives or by mechanical fasteners such as screws.

Many modifications and variations of the above invention are possible. It is therefore understood that the invention may be practiced otherwise than as specifically before described and still fall within the scope of the appended claims.

What is claimed is:

1. An elongated hand rail comprising:

(a) an outer shell having a top outer surface, a cavity disposed within said outer shell, said cavity having a plurality of sidewalls and an inner surface proximate to said top outer surface, and a shell bottom open to said cavity distal to said inner cavity surface;

(b) a core fixedly attached within said cavity, said core further comprising an outer edge, said core abutting said inner cavity surface and extending partially up said sidewalls toward said shell bottom, said core outer edge and said shell bottom defining a recess; and (c) a cap having a cap bottom and an interior surface, said interior surface being sized to fit within said sidewalls and against said core outer edge, said cap being fixedly attached to said sidewalls and said outer edge of said core.

2. The elongated hand rail of claim 1 wherein said top outer surface comprises an outermost extremity, a convex flare, an outermost width, a concave return, a waist, a decorative bead and a lowermost rim, said top outer surface curving outwardly and downwardly into said convex flare, said outermost extremity of said convex flare defining said outermost width of said tor outer surface, said top outer surface then downwardly curving into said concave return and thence to said waist, said waist continuing to said decorative bead; said decorative bead being terminated at said lowermost edge, said lowermost edge defining said shell bottom.

3. The elongated hand rail of claim 1 wherein said outer shell is comprised of an extruded cellular blended polyvinylchloride having a celuka skin.

4. The elongated hand rail of claim 2 wherein said outer shell is comprised of an extruded cellular blended polyvinylchloride having a celuka skin.

5. The elongated hand rail of claim 4 wherein said core is fixedly attached to said cavity by adhesive means.

6. The elongated hand rail of claim 2 wherein said shell is comprised of an extruded plastic.

7. An elongated hand rail comprising:

(a) a shell having a exterior surface, a bottom and a central cavity, said cavity being defined by a plurality of sidewalls and being open to said bottom, said exterior surface further comprising a downwardly sloping convex flare, a concave return, and a waist, said exterior surface having a gently curving downwardly disposed convex top joining said downwardly sloping convex flare, said downwardly sloping convex flare continuing into said concave return and thence to said waist;

(b) a core fixedly attached within said cavity and extending partially up said sidewalls; and (c) a cap further comprising a flange, said flange being sized to fit within said sidewalls, said flange being fixedly attached to said bottom, to said sidewalls, and to said core.

8. The elongated hand rail of claim 7 further comprising a decorative bead fixedly attached to said waist and forming a transition between said waist and said bottom.

9. The elongated hand rail of claim 7 wherein said shell is fabricated of extruded cellular blended polyvinylchloride with a celuka skin.

* * * * *